United States Patent [19]

Virtanen

[11] Patent Number: 4,540,358

[45] Date of Patent: Sep. 10, 1985

[54] APPARATUS FOR THE MANUFACTURE OF A PRECAST BUILDING ELEMENT OF CONCRETE

[76] Inventor: Pentti Virtanen, T-linja 38 A, 37800 Toijala, Finland

[21] Appl. No.: 558,418

[22] PCT Filed: Apr. 15, 1983

[86] PCT No.: PCT/FI83/00029

§ 371 Date: Nov. 30, 1983

§ 102(e) Date: Nov. 30, 1983

[87] PCT Pub. No.: WO83/03571

PCT Pub. Date: Oct. 27, 1983

[30] Foreign Application Priority Data

Apr. 16, 1982 [FI] Finland ..... 821340

[51] Int. Cl.[3] ..... B28B 21/06

[52] U.S. Cl. ..... 425/63; 425/59; 425/64; 425/89; 425/447

[58] Field of Search ..... 425/63, 59, 64, 89, 425/122, 123, 425, 426, 447

[56] References Cited

U.S. PATENT DOCUMENTS

| | | | |
|---|---|---|---|
| 857,586 | 6/1907 | Boyle | 425/59 |
| 3,193,901 | 7/1965 | Lee et al. | 425/59 |
| 3,773,874 | 11/1973 | Long | 425/64 X |
| 3,957,977 | 6/1976 | Godbersen | 425/59 X |
| 4,017,226 | 4/1977 | Long | 425/64 X |
| 4,181,696 | 1/1980 | Mayrl | 425/64 X |

*Primary Examiner*—J. Howard Flint, Jr.
*Attorney, Agent, or Firm*—Kemon & Estabrook

[57] ABSTRACT

Apparatus for manufacturing a hollow concrete slab by a slide casting operation. The slab is formed with one or more cavities through the use of tubes of flexible material into which a pressurized medium, particularly water, is fed. The apparatus comprises a stationary base and a casting device arranged to travel in the longitudinal direction of the base. A number of parallel shaping pipes forming part of the travelling casting device and having a cross section corresponding to the desired cross section of the cavities to be formed are opened at both ends. The flexible tubes, which are fastened at their rear ends, to a pressured liquid source pass during the casting process from reels in the casting device through the pipes so as to give the cavities their final form.

6 Claims, 5 Drawing Figures

APPARATUS FOR THE MANUFACTURE OF A PRECAST BUILDING ELEMENT OF CONCRETE

The present invention concerns an apparatus for the manufacture of a precast building element of concrete.

Precast building elements of concrete frequently consist of the following functional parts: a straight, plane top or bottom face, or simultaneously both of them, and of a supporting material connecting these faces, which material may be continuous or, as is frequently the case, made of longitudinal beams and of reinforcements that carry tensile strains.

In practice, such a precast element serves as a floor, ceiling, wall, or equivalent, the highest strains applied to such components being, besides their own weight, other strains directed downwards, mostly caused by the force of gravity.

In such a situation, the upper face of this precast concrete element must withstand compression forces, and the bottom face tensile strains. Out of these reasons, a portion of relatively low strength is required to bind the top face and the bottom face; in construction technology, an I-beam is known. When such I-beams are connected to each other, in the building technology, on the other hand, the notion of hollow slab has been adopted.

The problem in the manufacture of such a hollow slab or corresponding element is the formation of a cavity of desired shape continuously and without restriction in respect of the properties of the concrete mix used. The shape of the cavities is in each case determined by many individual factors.

In the prior art for the manufacture of hollow slabs that are used today, many compromises must be made between these factors and the properties of the concrete mix.

In such prior art in which the hollow slab is shaped continuously while taking advantage of the vaulting properties of fresh, substantially viscous concrete mix, at the stage of formation of the slab, a strong, rapidly varying force is required, which is, in concrete technology, called vibration.

In such a manufacture, when attempts are made to form hollow cavities of desired width in thick slabs, the intensive vibration causes difficult noise problems at the working sites as well as problems of strength of the machine elements to be used.

In order to avoid these drawbacks, attempts have been made to manufacture such hollow slabs or corresponding structural elements so that the cavity is shaped out of some inexpensive material while the concrete mix of substantially low viscosity is being cast around this material forming the hollow cavity.

Typically, such a material forming the cavity is sand or gravel or any other rock material, which can be removed on hardening of the building element of concrete in accordance with prior art technique (Finnish Pat. No. 47,295), e.g., by pouring, and which material can be used again as filler material for subsequent hollow slab elements to the extent that it did not adhere to the preceding element.

In such an operation a drawback consists of complicated machinery and equipment, recirculation of a large quantity of rock material with resulting losses of energy, and further the uneven faces of the cavities formed, which are harmful in the cases of certain application of use.

In an attempt to minimize the capital cost of such hollow slab factories, heating of the hollow slab elements has been introduced so as to make the necessary setting time of the concrete mix shorter.

This heating is mostly carried out so that the casting base of the concrete element cast is heated, the heat being conducted from the base further into the structural element itself.

Such a method always results in highly uneven heating of the cast object, with detrimental strains resulting therefrom, the strains being derived from different local temperatures and from resulting different degrees of setting of the concrete.

Now, after having studied how to form such a hollow slab most advantageously, it has surprisingly been discovered that there is a method in which all the desired aspects can be accomplished at the same time.

In this method, the desired cavities are produced by means of a liquid filler agent, said agent being isolated from the fresh concrete mix by a tight tubular wall made of a resilient material.

In such an apparatus, it is possible, by means of the liquid filler of the cavities, both to support and to heat the cast formed piece of concrete, and, no restrictions are imposed on the consistency of the concrete mix. Nevertheless, the casting apparatus required becomes simpler when a concrete mix of a relatively low viscosity is used.

The invention will be examined below in more detail by means of the exempliying embodiment in accordance with the attached drawing.

Figure 1:
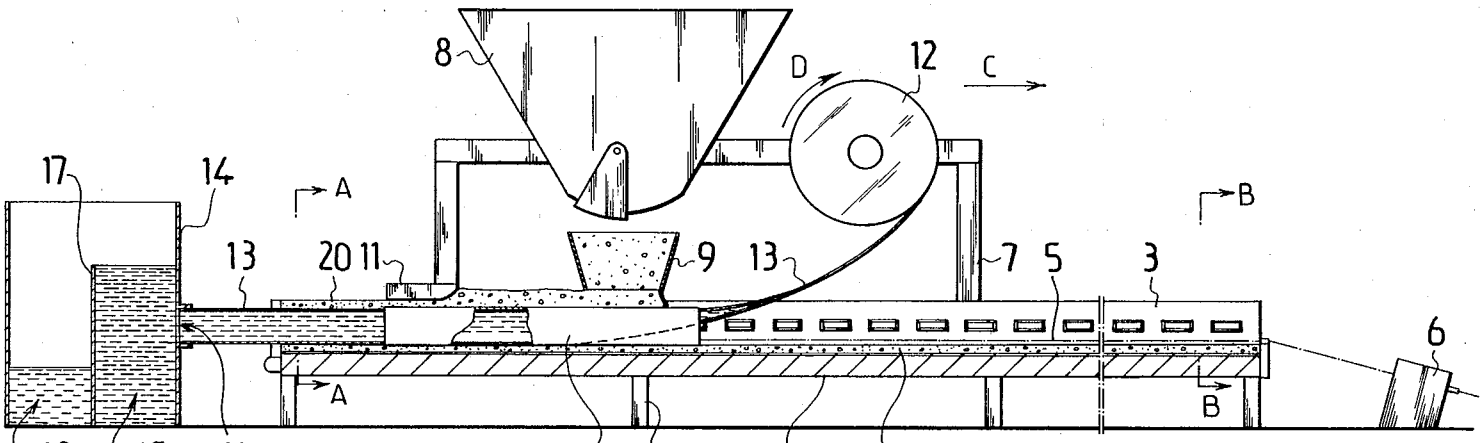
FIG. 1 is a sectional side view of one apparatus in accordance with the invention.
Figure 3:
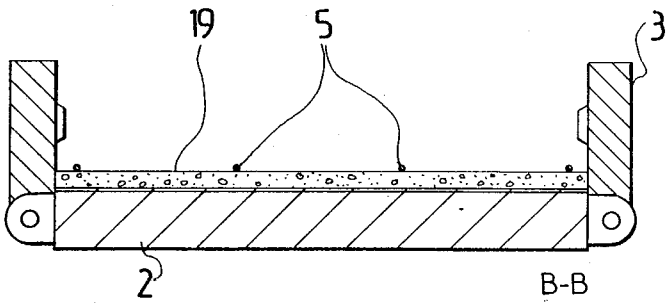
FIGS. 2 and 3 show sections along lines A—A and B—B, respectively, in FIG. 1 on an enlarged scale.
Figure 2:
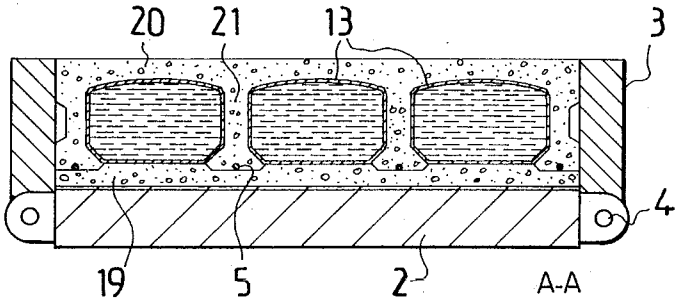

In practice, the element is cast on a base 2 which is sufficiently robust and provided with hinges 4, side boards 3, and frame members 1.

Onto this base 2, the concrete quantity 19 forming the bottom face of the desired element is cast, and air-tight tubes 13 with resilient walls, described in more detail below, are placed onto the bottom concrete, whereby the tubes 13 may be discharged, e.g., from reels 12 provided in the travelling casting device. During the glide casting operation, the casting device consisting of a frame 7, a storage 8, a funnel 9, the tubular shaping pipes 10, a rear forming board 11, and the reels 12 moves in the direction of the arrow C in relation to the base 2.

At the same time, these tubes 13 are filled, starting from the initial point of casting, with a liquid at constant pressure, which liquid has been heated to the desired temperature. Further, at the same time or slightly after the above, the casting process follows, wherein the space 21 between the filled tubes 13 and the top layer 20 covering the tubes and the spaces between them are filled with the concrete mix used.

The rear end of each tube 13 is connected to a tank 14 from which the liquid, e.g., water 15, enters the tubes 13 through openings 16 so as to create a pressure within the tubes 13. By means of a partition wall 17 forming an overflow member for the extra water 18 in the tank 14, the pressure can be kept constant.

When such a precast element is being formed, it is almost as a rule desirable to place structural components carrying tensile strains near the bottom face, these components being usually continuous iron bars or wires placed between the cavities formed into the element, these bars or wires being prestressed in certain embodiments.

These reinforcement strands 5, which carry tensile strains, may be placed inside the hollow slab element to be manufactured either after the casting of the separate bottom 19 of the element or by already placing them on the base before the casting of any concrete layer and by raising them during the casting process mechanically so that a desired quantity of fresh concrete mix remains underneath them. Reference numeral 6 denotes the stretching blocks for the strands 5.

In this method, when the latter concrete mix is being cast, which forms the space 21 between the hollow cavities and the top layer 20, it is possible to make the flexible tube 13 forming the cavities, now filled with liquid, to pass through the rigid shaping pipe 10, which, when travelling with the casting device, gives the tubes 13 filled with liquid the desired shape.

This shape can be readily made permanent by vibrating a sufficiently thixotropic concrete mix at the time when the shaping pipes 10 described above are still closely surrounding the tubes 13 with resilient walls. A sufficiently thixotropic nature of the concrete mix, which permits the permanence of the obtained shape on removal of the vibration, is best obtained by means of such a concrete mix as has been liquefied by using appropriate quantities of sulphonated organic polyelectrolytes and, correspondingly, essentially little quantities of water.

It should be mentioned that the degree of consistency of the concrete mix used is, e.g., VB°-0-10, and the temperature of the water used preferably 20° to 85° C.

Suitable organic polyelectrolytes are, e.g., naphtalere sulphonate condensation products, sulphonated melamine resins, as well as lignosulphonate products.

It is preferable to bring the concrete mix to be cast substantially to the same temperature as the liquid in the tubes.

After the concrete mix has set sufficiently, the heating liquid is drained out of the tubes forming the cavities, whereupon the flexible tubes with resilient walls can be pulled out of the completed concrete product.

It is also preferable to cast the concrete product on a substantially heat-insulating base and to cover the product with a heat insulation.

Figure 5:
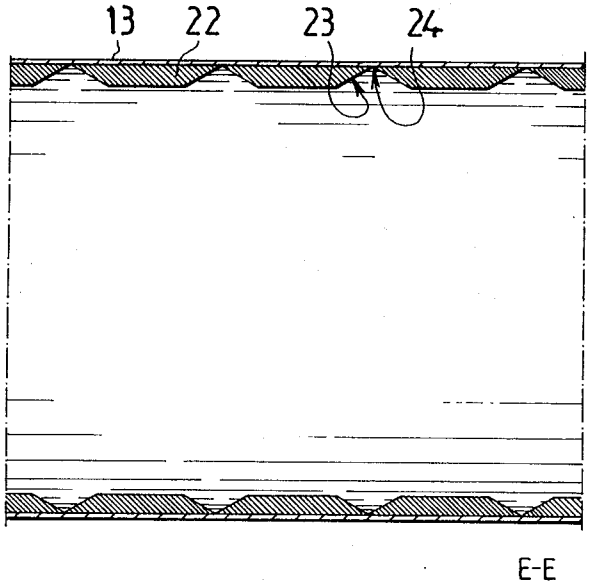
FIGS. 4 and 5 are sectional front and side views, respectively, of a flexible tube.
Figure 4:
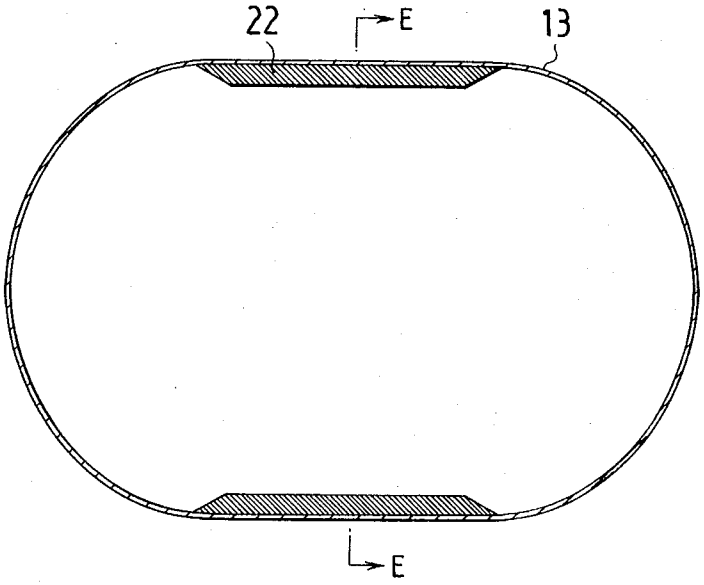

As seen in FIGS. 4 and 5, the tube 13 is provided with stiffening members 22 on the upper and lower inner side thereof. The members 22 are arranged in parallel relationship in the transversal direction of the tube 13 such that the slanting edges 23 of adjacent members 22 form grooves 24 reaching the inner side of the tube 13. Due to this arrangement, the tube 13 under pressure assumes a cross-section with two opposite sides in parallel relationship and, at the same time, allows an easy winding of the tube in deflated state on the reel 12. The members 22 are preferably made of a plastic material.

Within the scope of the invention, the tubes 13 can also be pressurized by means of pressurized gas, e.g, air.

I claim:

1. Apparatus for manufacturing a precast hollow concrete slab element comprising an elongated stationary base, a relatively flat concrete layer cast on said elongated base and constituting the bottom face of said slab element, a frame member positioned in vertical spaced relation to said elongated base and adapted to move in spaced parallel relation to said base, a reel mounted on said frame member, a flexible resilient tube positioned on said reel, a fluid tank positioned adjacent an end of said base, means for maintaining the fluid in said tank under pressure, an end of said resilient tube connected to said tank, the portion of said tube adjacent said tank supported on a portion of the bottom face of said slab element, a storage receptacle for concrete supported on said frame member, said storage receptacle having discharge means for delivering concrete onto said bottom face of said slab element and around said flexible tube contemporaneous with the movement of said frame member from one end to the other end of said stationary base.

2. Apparatus for manufacturing a precast slab element of claim 1 wherein fluid from said tank is delivered to said resilient tube for progressively inflating and maintaining said inflation upon the movement of said frame from one end to the other of said base.

3. Apparatus for manufacturing a precast slab element of claim 1 wherein said frame member is provided with at least one tubular shaping pipe for receiving a resilient tube from said reel and directly and positioning said tube onto said concrete layer.

4. Apparatus for manufacturing a precast slab element of claim 1 wherein said frame member is provided at one end with a forming board for smoothing the concrete about said resilient tube.

5. Apparatus for manufacturing a precast slab element of claim 1 wherein said frame member is provided with a reel having a plurality of resilient tubes with each tube having an end connected to said tank.

6. Apparatus for manufacturing a precast slab element of claim 1 wherein reinforcing elements are positioned within the slab element.

* * * * *